US005199514A

United States Patent [19]

Titus

[11] Patent Number: 5,199,514

[45] Date of Patent: Apr. 6, 1993

[54] SEAL FOR WELL DRILLING ASSEMBLY

[76] Inventor: Charles H. Titus, 323 Echo Valley La., Newtown Square, Pa. 19073

[21] Appl. No.: 793,608

[22] Filed: Nov. 18, 1991

Related U.S. Application Data

[63] Continuation-in-part of Ser. No. 516,151, Apr. 30, 1990, Pat. No. 5,069,298.

[51] Int. Cl.[5] ..... E21B 4/02

[52] U.S. Cl. ..... 175/107; 175/324; 277/56; 277/136; 277/174

[58] Field of Search ..... 175/107, 227, 228, 320, 175/324; 384/453, 484, 480; 415/903; 277/54, 56, 57, 65, 44, 51, 174, 176, 82, 83, 103, 136, 173

[56] References Cited

U.S. PATENT DOCUMENTS

| | | | |
|---|---|---|---|
| 1,722,489 | 7/1929 | Bott | 384/480 |
| 2,742,306 | 4/1956 | Kelso et al. | 277/174 |
| 3,145,787 | 8/1964 | Brown | 175/107 |
| 3,971,489 | 7/1976 | Fox | 415/903 X |
| 4,019,591 | 4/1977 | Fox | 175/107 |
| 4,114,702 | 9/1978 | Maurer et al. | 175/107 |
| 4,256,189 | 3/1981 | Fox et al. | 175/40 |
| 4,260,032 | 4/1981 | Fox | 175/107 |
| 4,260,167 | 4/1981 | Fox | 277/135 |
| 4,284,149 | 8/1981 | Fox | 175/40 |
| 4,308,927 | 1/1982 | Fox | 175/107 |
| 4,324,299 | 4/1982 | Nagel | 175/107 |
| 4,361,194 | 11/1982 | Chow et al. | 175/107 |
| 4,522,410 | 6/1985 | Holzer | 277/56 |
| 4,548,283 | 10/1985 | Young | 175/107 |
| 4,593,774 | 6/1986 | Lingafelter | 175/107 |
| 4,683,964 | 8/1987 | Wenzel | 175/107 |
| 5,069,298 | 12/1991 | Titus | 175/107 |

*Primary Examiner*—Hoang C. Dang

*Attorney, Agent, or Firm*—Dann, Dorfman, Herrell and Skillman

[57] ABSTRACT

A floating seal adapted particularly for sealing the bearings in a drill string for deep wells. The seal has an outer slide ring slidable longitudinally in the drill casing and an internal support ring mounted in the slide ring against relative axial displacement but adapted for eccentric radial displacement of the mounting ring relative to the slide ring. Rotary discs are provided in the outer slide ring to allow axial displacement of the slide ring but to resist rotary displacement of the slide ring in the casing. The mounting ring is mounted in the slide ring to afford radial displacement of the mounting ring but to resist relative rotational displacement between the mounting ring and the slide ring. Seals are provided between the outer surface of the slide ring and the interior surface of the casing; between the interior surface of the mounting ring and the exterior surface of the shaft; and also between the slide ring and the mounting ring.

14 Claims, 2 Drawing Sheets

SEAL FOR WELL DRILLING ASSEMBLY

RELATED APPLICATION

The present application is a continuation in part of my application Ser. No. 07/516,151, filed Apr. 30, 1990, now U.S. Pat. No. 5,069,298, issued Dec. 3, 1991.

FIELD OF THE INVENTION

The present invention relates to well drilling and is particularly applicable to a seal for use in an assembly used for drilling wells in which the drive motor for rotating the drill is positioned adjacent the lower end of the drill string.

BACKGROUND OF THE INVENTION

In drilling wells, a hollow tubular drill string is introduced into the well. Adjacent the bottom of the drill string, a drill tool casing houses a drive motor which rotates a central shaft which projects beyond the drill tool casing and mounts a drill bit. Rotation of the drill bit extends the length of the well as the drill tool casing is advanced incrementally.

The drive motor for the drill shaft may be hydraulic or pneumatic, of the positive displacement (PDM)or turbine type mounted within the drill tool casing. Conventionally, the motor is driven by forcing air or drilling mud through the casing and the motor. Drilling mud may consist of clay, water and/or oil, weighting material such as barium sulfate or hematite, sand, quartz, various types of pulverized, granulated or chips of abrasive material, and chemical polymers. Most frequently, drilling mud is pumped from the surface and through the drill string into the drill tool casing so that it fills the interior of the drill tool casing and the well annulus. The mud is formulated such that it exerts an isostatic pressure which increases on the order of 0.5–1.0 pounds per square inch per foot of depth in the well so that the isostatic pressure may be comparable to subterranean pressure at the bottom of the well in order to prevent well collapse Thus, at the bottom of a 15,000-foot well, the pressure in the drilling mud may be 15,000 psi.

The mud within the drill tool casing is used to drive the fluid motor, and the mud exhausted from the motor is directed through nozzles in the drill bit so as to expel chips and other material disintegrated by the drill bit and also to provide a coolant for cooling the cutting surfaces of the drill bit to improve its cutting efficiency. The pump is normally at the surface adjacent the well, and supplies mud at a pressure sufficient to overcome the pressure drop due to friction of the mud flowing through the drill string. This pressure is further elevated above isostatic pressure so as to drive the motor when its outlet is at isostatic pressure plus the pressure required to exhaust the mud through the nozzles in the drill bit, and upwardly through the annular space around the drill tool casing and along the entire length of the drill string to the surface for filtration and recycling.

In recycling the drilling mud, the larger particles of drilling debris are filtered from the mud in filters and settling tanks, but the constituents of the drilling mud themselves may still have high abrasive character. Although it is possible to design the fluid motor to withstand the flow of abrasive drilling mud through the motor, the bearing devices which center the rotary shaft within the drill tool casing are simultaneously subject to large fluctuating axial and radial mechanical forces and severe abrasion by the drilling mud. Conventional long-life sealed lubricated bearings are not available for use in an environment where the pressures may vary from atmospheric to more than 20,000 psi, and where the pressure medium is an abrasive fluid such as drilling mud. Substantial down time and cost is required to withdraw the drilling string from the drill hole for maintenance operations upon the motor, the bearing assembly, and the associated drill bit.

SUMMARY OF THE INVENTION

A primary object of the present invention is to provide an improved seal for use in a drilling assembly for positioning within the well hole, in which a hollow rotary shaft for mounting the drill bit is mounted by bearings in a drill tool casing for rotation but is retained against axial or radial displacement.

More specifically, the present invention provides an improved seal for the bearings so as to provide a body of lubricating fluid surrounding the bearings so that the body of fluid is maintained under an isostatic pressure comparable to the pressure of the drilling mud within the casing at that location, minimizing intermingling of the drilling mud and lubricating fluid.

The present invention provides a seal which may be subject to a wide range of pressures, yet which accommodates eccentric loading and/or displacement of the shaft between bearing points without losing the effectiveness of the seal.

All of the objects of the invention are more fully set forth hereinafter with reference to the accompanying drawings.

BRIEF DESCRIPTION OF THE DRAWINGS

In the attached drawings.

DESCRIPTION OF THE PREFERRED EMBODIMENT

Figure 1:
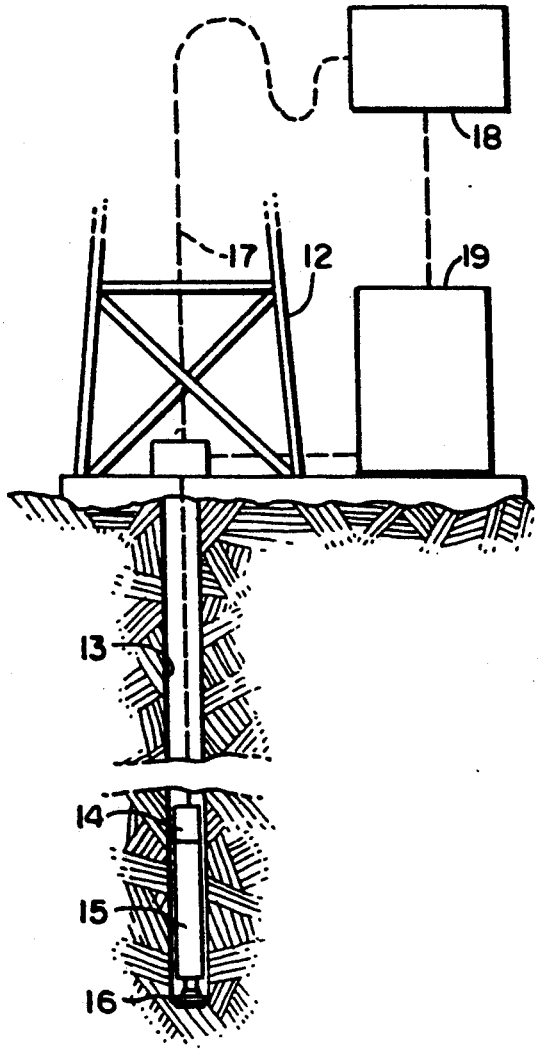
FIG. 1 is a thumbnail sketch of a drilling rig embodying the present invention.

The drilling assembly is illustrated diagrammatically in FIG. 1, wherein the well superstructure 12 is positioned over the well hole 13 to support a drill string 17 which is fed into the well. At the bottom of the drill string 17, are a motor casing 14 and a bearing assembly casing 15, at the lower end of which a drill bit shown diagrammatically at 16 projects downwardly to perform the drilling operation. The motor casing 14 mounts a fluid motor, in the present case a turbine (not shown), for rotating the drill bit 16. The turbine is driven by drilling mud which is introduced to the turbine through a conduit in the drill string 17 fed from a pump 18. The drilling mud is forced through the turbine to rotate the drill bit 16, and the discharge from the turbine is forced through the drill bit to assist in discharging drilling debris, to lubricate the drill bit, and to provide a cooling fluid to maintain the temperature of the drill bit at a suitable level. The drilling mud forced through the drill bit is discharged into the well hole 13 and flows upwardly around the casings 14 and 15 and the drill string 17 and is discharged from the top of the well hole 13. The spent drilling mud is captured and recycled to the pump through suitable filtration apparatus 19 which conventionally includes shaker screen filters and settling tanks to remove drilling debris which is entrained in the spent drilling mud.

The turbine is mounted in the motor casing 14, and has a hollow drive shaft 26 projecting downwardly coaxially within the casings 14 and 15. The shaft 26 is driven by the turbine rotor at a rotary speed in the range of 50 to 1000 rpm, depending upon the character of the subterranean formations and the type of drill bit used. Drilling mud is discharged from the turbine at a volumetric flow on the order of 200 to 600 gallons per minute.

The bearing assembly casing 15 houses the hollow drive shaft 26 which extends throughout the length of the bearing assembly casing 15, and mounts the drill bit 16 at its lower end. Suitable seals (not shown) are provided between the casings 14 and 15 to prevent escape of drilling mud from the interior of the casings.

Ports, not shown in the drawings but shown and described in my U.S. Pat. No. 5,069,298, direct the drilling mud into the hollow interior of the shaft 26 which serves as a flow passage for the mud. An interconnection is provided between the hollow interior of the shaft 26 and the annular space between the shaft 26 and the casing 15 above and below the bearing assembly in the casing. The lower interconnection is shown at 72 in FIG. 2. In the present instance, the interconnection 72 comprises a plurality of radial passageways through the wall of the hollow shaft 26. The upper and lower interconnections transmit the isostatic pressure of the drilling mud within the center of the hollow shaft 26 to the annular spaces above and below the bearing assembly in the casing 15. The pressure differential between the interconnections is insubstantial so that the body of lubricant in the bearing assembly is subject to the same isostatic pressure as the drilling mud.

As shown in U.S. Pat. No. 5,069,298, the disclosure of which is incorporated herein by reference, the shaft 26 is supported for rotation within the casing 15 by upper and lower radial bearings and axial thrust bearings (not shown in the attached drawings). The present invention enables the use of standard, off-the-shelf bearings which may be selected according to the operating parameters of the particular drill bit. The radial bearings are spaced apart along the length of the tool casing 15 and two thrust bearings are positioned centrally between the upper radial bearing (not shown) and the lower radial bearing 51. The bearings may be single- or multi-race, may be roller or ball, and may be self-aligning spherical or tapered, depending upon the design parameters selected in accordance with the operating conditions within the well hole. The radial bearing 51 is positioned in the casing 15 by thin sleeves 53 which engage axially against the outer races of the bearings. In the present instance, the inner races of the radial bearings may be displaced axially on the shaft 26 to accommodate the deflections which may occur during drilling operations. The bearings mounted between the shaft and the casing accommodate the impacts imparted by the drill bit engaging subterranean formations and the myriad forces applied to the shaft 26 during the drilling operations.

In accordance with the invention, the use of standard bearings is enabled by reason of the novel sealing arrangement provided by the present invention. The sealing arrangement enables the bearings to be engulfed in a body of lubricant which is confined in the annular space providing a pressure passage 49 between the outside of the shaft 26 and the interior wall of the casing 15 The lubricant may be oil or grease, or any suitable fluent material which is effective to lubricate the bearings under the conditions extant in the drill hole. The lubricant is confined to the pressure-passage space 49 by multiple floating seals 62 which are operable to be displaced along the length of the tubular members 53. In the present instance, there are three floating seals above the upper radial bearing, a single floating seal between the upper bearing and the thrust bearings, a single seal below the thrust bearings and above the lower radial bearing 51 and three seals below the lower radial bearing 51.

Figure 2:
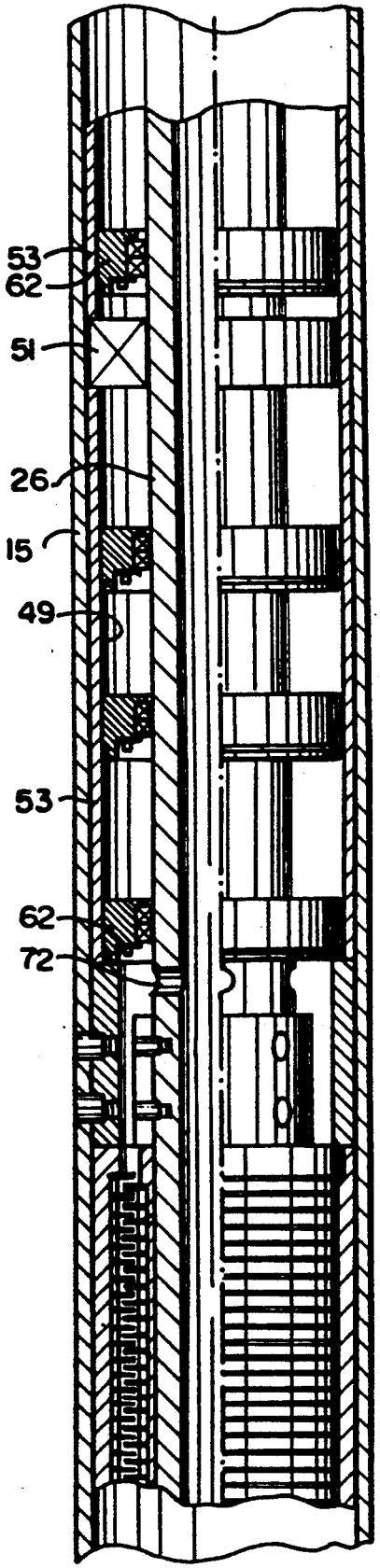
FIG. 2 is a fragmentary view, partially in section, of a portion of the drilling assembly embodied in the drilling rig of FIG. 1.

The seals in FIG. 2 are identical and comprise a support ring adapted to slide longitudinally within tubular positioning sleeve 53. The ring is axially elongated to enable longitudinal sliding movement without cocking. The outer surface has an O-ring seal adjacent the end which confronts the drilling mud and remote from the end which confronts the lubricant. On the inside of the ring 62, a packing ring is carried and anchored in place by an anchor element. In FIG. 2, the packing ring comprises elastomeric sealing gaskets confined between a pair of angular support rings to enable the anchor element to compress the sealing gaskets against the outer wall of the rotary shaft 26. The shape and composition of the packing may be selected in accordance with the operating conditions within the well hole, for example as determined by the subterranean temperature in the hole, the composition of the drilling mud, the nature of the material being drilled, etc.

The floating nature of the seals 62 permits the assembly to accommodate to the deflections, impacts and vibrations inherent in the operation of the drill, and as the lubricant migrates out of the pressure-passage space between the uppermost and lowermost seals, these seals approach one another to reduce the space and minimize infiltration of drilling mud into the space to replace the lubricant.

It is expected that in normal operation, the drilling mud will eventually infiltrate the space between the seals, but the use of multiple seals will inhibit the travel of the mud. The contamination of the body of lubricant with drilling mud will be concentrated at the opposite ends of the bearing assembly, and the contamination of the lubricant will reach the radial bearings long before it progresses beyond the innermost floating seals where it may contaminate the body of lubricant engulfing the thrust bearings. Inasmuch as the thrust bearings are subject to the greatest forces, their operating life is substantially prolonged by reason of the delay in permitting contamination of the lubricant in which the thrust bearings operate.

Figure 3:
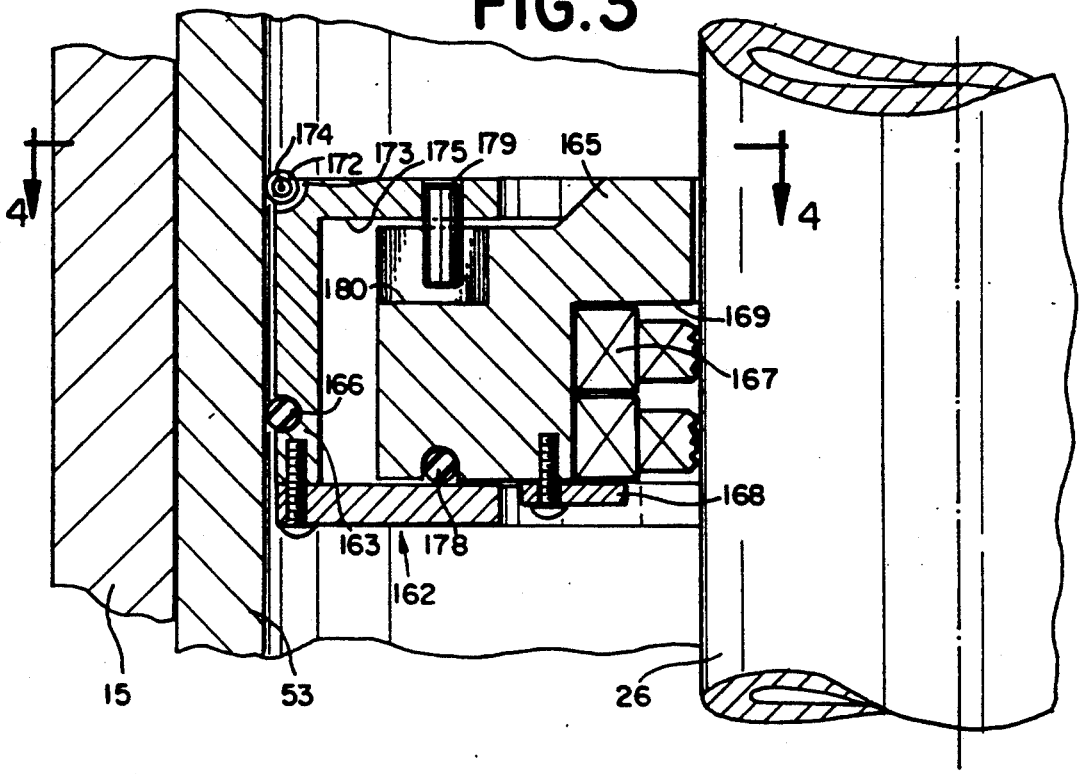
FIG. 3 is an enlarged view of a portion of the assembly embodying a preferred alternate embodiment of the floating seal shown in FIG. 2.
Figure 4:
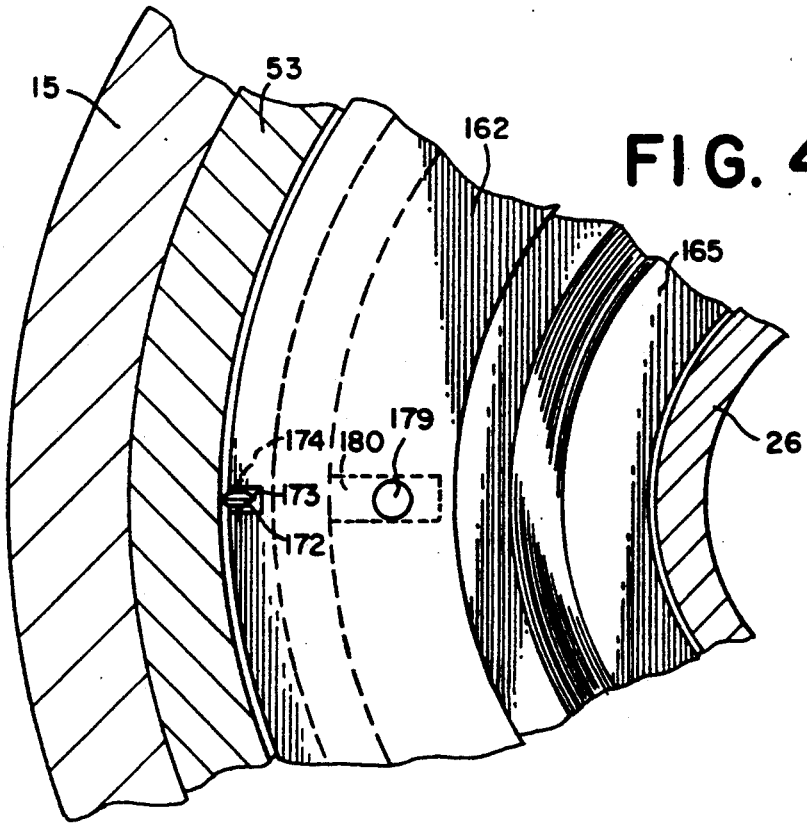
FIG. 4 is a fragmentary sectional view taken on the line 4—4 of FIG. 3.

In order to further inhibit the migration of drilling mud through the seals, an alternate embodiment of floating seal is provided as illustrated in FIGS. 3 and 4. This alternate embodiment is preferred to accommodate the displacement and distortion of the shaft which occurs when drilling through hard rock formations and the like which impart both lateral and longitudinal thrusts on the hollow shaft supporting the drill bit.

The lateral thrust on the shaft 26 may cause the shaft 26 to be displaced from its central position in the casing 15, or may cause distortion of the shaft between its bearings, and in accordance with the present invention, an improved seal 162 provides an arrangement which accommodates eccentric loading of the shaft 26. To this end, as shown in FIGS. 3 and 4, the seal 162 has a slide ring 163 which is axially elongated to enable longitudinal sliding movement within the tubular member 53 without cocking. At the end of the elongated ring which confronts the drilling mud, an O-ring seal 166 circumscribes the ring 163. At the opposite end of the ring 163, rotary discs 172 are mounted in axial slots or notches 173 adjacent the end of the ring which confronts the lubricant. Each disc 172 is supported by an axle 174 bridging the slot 173 and affording rotation of the disc about an axis generally parallel to the arcuate interior surface of the sleeve 53 within a plane perpendicular to the rotary axis of the shaft 26, to enable free vertical movement of the slide ring 163 axially of the shaft 26. Each disc 172 is preferably sharpened about its perimeter so as to bite into the wall of the sleeve 53 and resist rotation of the slide ring 163 about the central axis of the drill string. Preferably, there are at least three discs spaced equally about the circumference of the slide ring 163, assuring at least two biting engagements of discs with the tubular member 53. In larger drill strings, as many as six discs may be spaced equally about the perimeter of the slide ring.

The ring 163 is generally U-shaped in cross section, consisting of an axial wall and a pair of inwardly-directed radial flanges which provide an annular space 175 which accommodates an annular support ring 165, which preferably is formed of bronze and has an inner periphery which closely conforms to the outer diameter of the hollow shaft 26 in the nature of a sleeve bearing. The support ring 165 mounts packing elements shown diagrammatically at 167 in a cutout 169, in the present instance closed by a cover plate 168. The support ring 165 and the packing 167 maintains the separation between the lubricant above the ring and the drilling mud below the rings. Bleeding of drilling mud into the hollow 175 is retarded by an O-ring 178 between the lower surface of the mounting ring 165 and the lower radial flange of the slide ring 163.

Eccentric loading of the shaft 26 may cause distortion of the shaft between its bearing points and cause eccentric rotation of the hollow shaft 26 within the casing 15. The eccentricity of the shaft rotation is accommodated by radial displacement of the support ring 165 within the hollow annular space 175 in the slide ring 163. To this end, the outer periphery of the support ring is smaller than the inside circumference of the axial wall of slide ring 163. The radial flanges of the slide ring capture the support ring and prevent relative axial displacement of the rings. The spacing between the support ring and the axial wall of the slide ring allows relative radial displacement of the rings. Rotation of the support ring 165 relative to the ring 163 is limited by a pin 179 projecting from the upper radial flange of the slide ring 163 into a radial slot 180 in the support ring 165. The pin 179 has limited clearance within the slot 180 to permit the radial displacement of the mounting ring 165 relative to the slide ring 163 in response to eccentric displacement of the shaft 26 within the casing 15. The outer dimension of the support ring 165 is greater than the inner dimension of the radial flanges, so that the flanges capture the support ring 165 within the slide ring 163.

Preferably, the packing 167 consists of one or more metal reinforced elastomeric type lip seals. The mounting ring 165 is a floating bronze ring containing the lip seals. This radial freedom of motion permits the metallic portion of packing elements 167 and the mounting ring 165 to permit shaft 26 to freely rotate while maintaining only a small radial clearance between the shaft 26 and the support ring 165, thereby moving the seal 167 so that regardless of any bending or transient radial excursion of shaft 26, the seals will not lift from the shaft so that they may effectively perform their intended sealing function while at the same time producing minimal wear of either the seals or shaft.

Field tests have indicated that the use of this sealing arrangement extends the operating life of the seals within the drill string and enables operation of the drill string without withdrawal of the string from the hole for prolonged periods as much as three or four times the normal operating period between shutdowns for maintenance.

While a particular embodiment of the sealing arrangement has been illustrated and described, it is not intended to limit the invention to such disclosure, but changes and modifications may be made therein and thereto within the scope of the following claims.

I claim:

1. In a drilling assembly comprising a drill bit operable to be rotated to produce a well hole of a given diameter, a hollow casing at a level spaced above the drill bit at the bottom of the hole, an upright rotary shaft mounted in said casing and projecting downwardly from said casing at its lower end to rotate the drill bit, rotary drive means drivingly connected to said rotary shaft for rotating said shaft about the axis of said well hole, flow passages for directing drilling mud to said drill bit, the lower end of the rotary shaft having an outer cylindrical surface with an outer diameter less than the interior dimension of said casing to provide an outer pressure passage therebetween, said flow and pressure passages having upper and lower interconnections at spaced upper and lower locations along the casing respectively, bearings in said pressure passage between said upper and lower interconnections, said bearings supporting said rotary shaft in said casing against radial and axial displacement relative to said casing, a body of lubricant in said pressure passage between said shaft and said casing engulfing said bearings, and upper and lower seals between said body and said upper and lower interconnections to respectively limit flow of drilling mud into said body of lubricant, and flow of lubricant from said body toward said interconnections, the improvement wherein said casing has an interior circumferential surface surrounding the lower end of said rotary shaft, each seal of said upper and lower seals comprising a slide ring mounted between said interior circumferential surface and said outer cylindrical surface and slidable longitudinally therealong, said slide ring of each seal having one transverse surface directed toward one of said interconnections and another transverse surface directed toward one of said bearings, said slide ring about its outer periphery being in sealing engagement with said interior surface, mounting means for positioning packing elements around the inner periphery of each seal in sealing engagement with said outer surface, whereby said ring may slide longitudinally of said rotary shaft while maintaining a sealed transverse barrier across the pressure passage between said outer surface of said shaft and the interior surface of said casing, and means to resist rotary movement of said slide ring within said interior surface about said well hole axis comprising a disc mounted in said slide ring for rotation about an axis generally parallel to the interior circumferential surface within a plane perpendicular to the rotary axis of said shaft, said disc engaging said interior circumferential surface of said casing and resisting rotation of said slide ring about the axis of the shaft but affording axial displacement of said slide ring therealong.

2. A drilling assembly according to claim 1 wherein said bearings include axial thrust bearing means positioned in said pressure passage centrally intermediate said upper and lower interconnections, upper radial bearing means between said axial thrust bearing means and said upper interconnection, and lower radial bearing means between said axial thrust bearing means and said lower interconnection, wherein further said upper seal is slidable longitudinally in said pressure passage between said upper radial bearing means and said upper interconnection, and said lower seal is slidable longitudinally in said pressure passage between said lower radial bearing means and said lower interconnection, said body of lubricant being confined between said upper and lower seals.

3. A drilling assembly according to claim 2 wherein each of said upper and lower seals comprises a second slide ring, a second mounting means and means to resist rotary movement of said second slide ring in said pressure passage respectively between said uppermost sealing device and said upper radial bearing means, and between said lower radial bearing means and said lowermost sealing device.

4. A drilling assembly according to claim 1 wherein the rotary disc has a sharpened perimeter operable to bite into said interior circumferential surface.

5. A drilling assembly according to claim 1 including at least three discs spaced equally about the circumference of the slide ring.

6. A drilling assembly according to claim 1 wherein said disc is journaled for rotation in said slide ring adjacent the surface of the ring which confronts the bearings, and including a sealing element surrounding said slide ring and engaging between said slide ring and said interior circumferential surface adjacent the surface of said slide ring which confronts the adjacent interconnection.

7. In a drilling assembly comprising a drill bit operable to be rotated to produce a well hole of a given diameter, a hollow casing at a level spaced above the drill bit at the bottom of the hole, an upright rotary shaft mounted in said casing and projecting downwardly therefrom at its lower end to rotate the drill bit, rotary drive means drivingly connected to said rotary shaft for rotating said shaft about the axis of said well hole, flow passages for directing drilling mud to said drill bit, the lower end of the rotary shaft having an outer cylindrical surface with an outer diameter less than the interior dimension of said casing to provide an outer pressure passage therebetween, said flow and pressure passages having upper and lower interconnections at spaced upper and lower locations along the casing respectively, bearings in said pressure passage between said upper and lower interconnections, said bearings supporting said rotary shaft in said casing against radial and axial displacement relative to said casing, a body of lubricant in said pressure passage between said shaft and said casing engulfing said bearings, and upper and lower seals between said body and said upper and lower interconnections respectively to limit flow of drilling mud into said body of lubricant, and flow of lubricant from said body toward said interconnections, the improvement wherein said casing has an interior circumferential surface surrounding the lower end of said rotary shaft, each seal of said upper and lower seals comprising a slide ring mounted between said interior circumferential surface and said outer cylindrical surface and slidable longitudinally therealong, said slide ring about its outer periphery being in sealing engagement with said interior surface, and mounting means for positioning packing elements around the inner periphery of said seal in sealing engagement with said outer surface, whereby said ring may slide longitudinally of said rotary shaft while maintaining a sealed transverse barrier across the pressure passage between said outer surface of said shaft and the interior surface of said casing, means to restrict rotary movement of said slide ring comprising at least one disc mounted in said slide ring for rotation about an axis generally parallel to the interior circumferential surface within a plane perpendicular to the rotary axis of said shaft, said disc engaging said interior circumferential surface of said casing and resisting rotation of said slide ring about the axis of the shaft but affording axial displacement of said slide ring therealong, and said mounting means comprising a support ring separate from said slide ring and mounted for eccentric radial displacement within and mounted against axial displacement relative to said slide ring, and means providing a seal between said rings throughout such radial displacement.

8. A drilling assembly according to claim 7 wherein said slide ring is generally U-shaped in cross section, providing an annular space to accommodate said support ring for relative radial displacement of said rings, said annular space limiting relative axial displacement of said rings.

9. A drilling assembly according to claim 8 wherein said U-shaped slide ring comprises a circumferential axial wall and a pair of inwardly-directed radial flanges, the outer dimension of said support ring being greater than the inner dimension of said flanges and less than the inner dimension of said axial wall to thereby confine said support ring within said space.

10. A drilling assembly according to claim 9 wherein said sealing means between said mounting ring and said slide ring comprises an O-ring seal positioned between one of said radial flanges and a confronting surface of the support ring.

11. A drilling assembly according to claim 9 wherein one of said flanges has a pin projecting into said annular space, and said support ring has a radial slot receiving said projecting pin to limit relative rotary movement of said rings while affording relative axial displacement thereof.

12. A drilling assembly according to claim 11 wherein said axial wall of the slide ring has a plurality of axial slots equally spaced about its circumference adjacent one end of said wall, a disc mounted for rotation in each slot and having an axle disposed substantially parallel to the interior circumferential surface of said casing in a plane substantially perpendicular to the rotary axis of said shaft to afford rotation of said disc to permit axial displacement of said slide ring and resist circumferential displacement thereof relative to said interior surface, and sealing means at the opposite end of said axial wall in sealing engagement between said axial wall and said interior circumferential surface.

13. A floating seal for sealing an annular passage between a shaft and a casing surrounding said shaft, the shaft having an outer surface and the casing having an interior surface substantially parallel to the shaft outer surface, the shaft having a central longitudinal axis and being subject to distortion which effects radial displacement of its outer surface eccentric to said central axis, said seal comprising a slide ring adapted to be mounted between said interior circumferential surface and said outer cylindrical surface and slidable longitudinally therealong, said slide ring about its outer periphery having sealing means affording sealing engagement with said interior surface, and a plurality of discs, each mounted for rotation on an axis substantially parallel to the interior circumferential surface of said casing in a plane substantially perpendicular to said central axis to afford rotation of said disc to permit axial displacement of said slide ring and resist circumferential displacement thereof relative to said interior surface, a support ring for positioning packing elements around the inner periphery of said seal for sealing engagement with said outer surface, whereby said ring may slide longitudinally of said rotary shaft while maintaining a sealed transverse barrier across the pressure passage between said outer surface of said shaft and the interior surface of said casing, said support ring being separate from said slide ring and mounted for eccentric radial displacement within and mounted against axial displacement relative to said slide ring, and means providing a seal between said rings throughout such radial displacement.

14. A floating seal according to claim 13 including pin and slot means between said slide ring and said support ring affording said eccentric radial displacement and resisting relative rotational displacement of said rings about said central axis.

* * * * *